United States Patent [19]

Mertes et al.

[11] 4,307,479

[45] Dec. 29, 1981

[54] ANGLE TUFTED ROTARY BRUSH ASSEMBLY

[75] Inventors: Richard H. Mertes, Tequesta, Fla.; Russell H. R. Parker, Cleveland, Ohio

[73] Assignee: Superior Brush Company, Cleveland, Ohio

[21] Appl. No.: 86,463

[22] Filed: Oct. 19, 1979

[51] Int. Cl.[3] ..... A46B 9/02; A46B 13/02

[52] U.S. Cl. ..... 15/182; 15/183; 15/DIG. 5; 15/159 A

[58] Field of Search ..... 15/179, 180, 181, 182, 15/183, 364, 366, 383, 384, 386, DIG. 5, DIG. 6

[56] References Cited

U.S. PATENT DOCUMENTS

| | | | |
|---|---|---|---|
| 1,005,801 | 10/1911 | Birch | 15/179 |
| 2,740,985 | 4/1956 | Kaufman | 15/183 X |
| 2,753,583 | 7/1956 | Jepson | 15/182 X |
| 3,533,125 | 10/1970 | Buechel et al. | 15/183 |
| 3,588,937 | 6/1971 | Scruggs et al. | 15/182 X |
| 3,683,444 | 8/1972 | Schaefer et al. | 15/183 |
| 3,742,549 | 7/1973 | Scoop et al. | 15/167 R |
| 3,758,915 | 9/1973 | Zeski et al. | 15/182 |
| 3,874,017 | 4/1975 | Parker | 15/182 |
| 4,173,807 | 11/1979 | Maier | 15/179 |

FOREIGN PATENT DOCUMENTS

| | | | |
|---|---|---|---|
| 495982 | 11/1938 | United Kingdom | 15/106 |
| 677744 | 8/1979 | U.S.S.R. | 15/182 |

*Primary Examiner*—Peter Feldman

*Attorney, Agent, or Firm*—Watts, Hoffmann, Fisher & Heinke Co.

[57] ABSTRACT

A rotary brush assembly, suitable for use in a vacuum cleaner, is disclosed. The assembly includes a generally cylindrical brush roller body carrying an array of helical rows of bristle tufts. In one embodiment, bristle tufts near a midplane normal to the roller body axis and equidistant between its ends are substantially normal to the roller body axis. Other bristle tufts are angled away from the midplane in an amount which is an increasing function of their distance from the midplane. Bristle stiffness is an increasing function of the degree of tuft angulation.

In another embodiment, the roller body defines helical grooves in its outer surface, and two brush strip substrate portions bearing the bristle tufts are inserted end to end in each groove. Adjacent brush strip ends define structure for interlocking the brush strips for inhibiting longitudinal separation of the brush strips, which would otherwise tend to result from brush rotation. In this embodiment, bristle tuft angulation from the normal is a function of tuft displacement from the midpoint of each individual substrate portion.

4 Claims, 7 Drawing Figures

ANGLE TUFTED ROTARY BRUSH ASSEMBLY

BACKGROUND OF THE INVENTION

1. Field of the Invention

This invention relates to the field of brushes, and more particularly to an improved angled bristle array configuration in a rotary brush assembly of the type used in vacuum cleaners.

2. Description of the Prior Art

The use of rotary brush assemblies in cleaning apparatus such as vacuum cleaners is well known. Rotary brush assemblies have included a generally cylindrical brush roller body carrying on its outer surface an array of radially extending tufted bristles. The roller body is mounted on the vacuum cleaner for powered sweeping rotation, to loosen debris to facilitate its removal by appropriate air flow. Beater bars are sometimes also attached to the roller body to enhance cleaning efficiency. The bristle array and beater bars are distributed regularly about the periphery of the roller body to balance the moments of inertia about the roller body axis.

An example of a prior art rotary brush assembly is described in U.S. Pat. No. 3,874,017, issued on Apr. 1, 1975 to Russel H. R. Parker, and assigned to the present Assignee. This patent is expressly incorporated by reference here.

One form of known rotary brush assembly includes a brush roller having several helical rows of bristle tufts distributed on its periphery. In such an assembly, the bristles extend outwardly from the brush roller substantially perpendicular to the roller axis. It has been proposed that alternate rows of bristles about the roller circumference comprise bristles having differing degrees of stiffness. For example, one proposal is to use alternate rows of horse and goat hair.

It has also been proposed to drill holes in the outside surface of a wooden cylindrical roller body at differing angles with respect to its axis. Identical bristle tufts were then inserted in the various holes and fastened therein with wire staples or the like. In such an assembly, in order to achieve a wider sweeping range and to improve edge cleaning capability, it has been proposed that the end bristle tufts near the roller body ends be angled outwardly.

Such rotary brush assemblies have exhibited undesirable nonuniformity in sweeping efficiency along the length of the assembly.

Such assemblies have included the use of somewhat longer bristles for the more angled tufts than in those which are more closely perpendicular to the roller body axis. Such an arrangement provides equal bristle extension from the roller body axis. Residual sweeping nonuniformity remained, because the longer, more angled, bristles were less stiff than the shorter, less angled ones.

It is thus an object of this invention to provide a rotary brush assembly having advantages of appropriately angled bristle tufting without disadvantages of nonuniform sweeping action.

SUMMARY OF THE INVENTION

A rotary brush assembly is provided which obviates the foregoing disadvantages of prior structure. Such an assembly includes a generally cylindrical brush roller body carrying an array of bristles. The bristles are angled, with respect to the roller body axis, in an amount which is a function of the longitudinal bristle location along the roller body. Additionally, the stiffness of the individual bristles is a function of bristle angulation.

This structure affords the advantages of wider cleaning range and good edge cleaning capabilities associated with bristle angulation, while ameliorating previous nonuniformity of cleaning action along the length of the brush assembly.

A more specific aspect of the invention involves providing bristles having a diameter which is an increasing function of the degree of angulation of the bristles. This structure results in the more angled bristles having greater stiffness than those of lesser angulation. Hence, the more angled bristles can be longer, without sacrificing uniformity of cleaning action along the roller body length.

According to another specific feature, the roller body defines grooves in its external surface, for accomodating portions of brush strip substrate material into which bristle tufts are inserted.

In one specific embodiment, a single brush strip extending substantially the entire length of a groove from one end of the roller body to the other is provided. In such an embodiment, bristle tufts near the midplane of the roller body are substantially normal to the roller body axis, while tufting near the ends is angled outwardly away form the midplane.

In a different embodiment, two portions of brush strip substrate material carrying tufts are laid end to end in each groove. In such an embodiment, tufts near the middle of each separate brush strip substrate portion are normal to the roller body axis, while tufting at each end of each of the substrate portions is angled outwardly.

In accordance with another aspect of the invention, there is provided a rotary brush assembly including structure adapted for holding an array of bristles of differing length attached to the bristle holding structure. The bristles are provided with a stiffness which is an increasing function of bristle length.

In accordance with a more specific aspect of the invention, a rotary brush assembly is provided including structure adapted for holding a bristle array and an array of bristles of differing length attached to the bristle holding structure. The bristles have a diameter which increases with respect to bristle length.

Another feature of the invention comprises a rotary brush assembly having a generally cylindrical brush roller body and two brush strip substrate portions placed end to end and attached to the roller body. As previously described, the brush strip substrate portions each carry an array of bristle tufts. Locking structure is provided for coupling together adjacent ends of the brush strip substrate portion, to inhibit their longitudinal separation which tends to result from rapid rotation of the rotary brush assembly.

In accordance with a more specific feature, the locking structure is integrally defined by the adjacent ends of the brush strip portions themselves.

This invention will be understood in more detail by reference to the following detailed description, and to the drawings, in which:

DESCRIPTION OF THE PREFERRED EMBODIMENT

Figure 1:
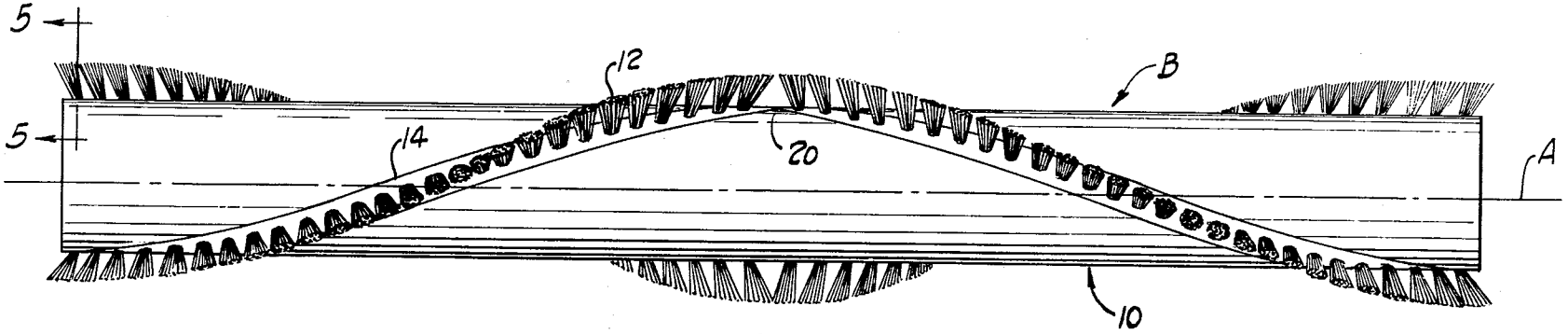
FIG. 1 is an elevational view of a rotary brush assembly incorporating the present invention.

FIG. 1 illustrates a rotary brush assembly B incorporating the present invention. The brush assembly B includes a generally cylindrical roller body 10 having an axis A and carrying an array of bristle tufts, indicated for example at 12, on its external surface. The assembly B is suited for incorporation in known fashion into a vacuum cleaner. In such an application, the rotary brush assembly is power rotated at high speed in the vicinity of the swept surface, so that its bristles loosen debris from the surface to facilitate its removal by appropriate air flow generated by the cleaner.

Figure 5:
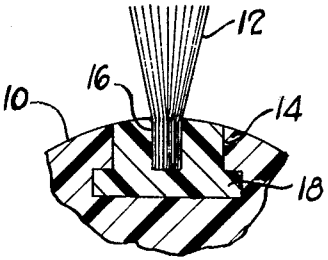
FIG. 5 is another detailed cross-sectional view of a portion of the assembly of FIG. 1, taken along the lines 5—5.

In the embodiment of FIG. 1, the roller body defines a set of generally helical grooves 14 in its surface. One of the grooves 14 is illustrated in detailed cross-section in FIG. 5. The grooves 14 are preferably disposed symmetrically about the outer surface of the roller body 10.

Figure 2:
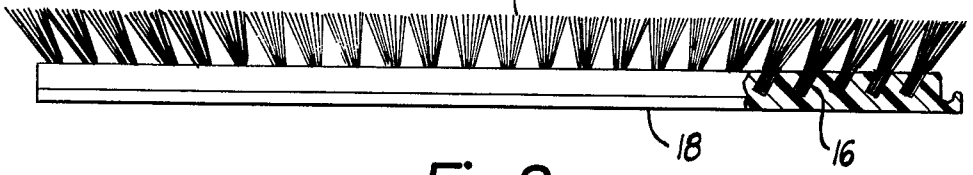
FIG. 2 is an elevational view, partially broken away, of a portion of the assembly shown in FIG. 1.

The bristle tufts 12 are mounted in and comprise parts of brush strip elements, an example of which is illustrated in FIG. 2. Each brush strip includes a plurality of bristle tufts 12 inserted into holes, such as 16, drilled into a brush strip substrate portion 18. The brush strip substrate portion is preferably made from a durable plastic material, and has a cross-sectional configuration similar to the interior cross-sectional configuration of the groove 14.

Thus, bristle tufts 12 can be mounted on the outer surface of the roller body 10 by inserting the brush strip substrate portions, bearing the bristle tufts, in the respective grooves defined in the roller body surface.

Preferably, and as illustrated in FIG. 1, two brush strips, each bearing bristle tufts, are inserted end to end in each roller body surface groove. In FIG. 1, the junction between brush strips is referred to by the reference character 20.

The angulation of each bristle tuft is a function of its respective location along the length of the brush strip, as shown in FIG. 2. More specifically, the tufting in the region near the middle of each brush strip is substantially normal to the longitudinal axis of the strip. The angulation of each tuft with respect to the normal is an increasing function of the longitudinal distance of the tuft from the middle of the brush strip. Angulation of bristle tuft increases from zero degrees, with respect to the normal, at the brush strip middle, to approximately thirty degrees outwardly from the normal at each end of the brush strip.

Longer bristles are provided for tufts more outwardly angled than for those tufts less angled. Bristle length increases with respect to increasing angulation in order that all the bristles extend a substantially equal distance transverse from the brush strip substrate material, and consequently from the axis A of the roller body 10. This feature tends to enhance uniformity of cleaning performance of the rotating brush assembly along its entire axial length.

The more angled, and hence longer, bristle tufts are provided with stiffer bristles than are the less angled and shorter tufts. In a specific embodiment, the bristles of the brush assembly are made of nylon. Bristles angled less than approximately fifteen degrees to the normal have a diameter of approximately 0.006 inches. Bristles angled more than approximately fifteen degrees to the normal are provided with a diameter of approximately 0.008 inches.

This additional stiffness for the longer bristles further enhances uniformity of the vigor of the sweeping action along the length of the brush assembly.

Figure 4:
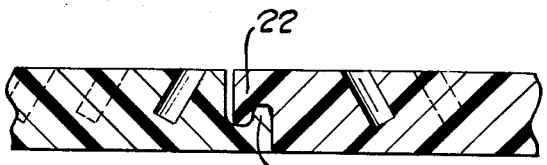
FIG. 4 is a cross-sectional detailed view of a portion of the structure of FIG. 3 taken along the lines 4—4 of FIG. 3.
Figure 3:
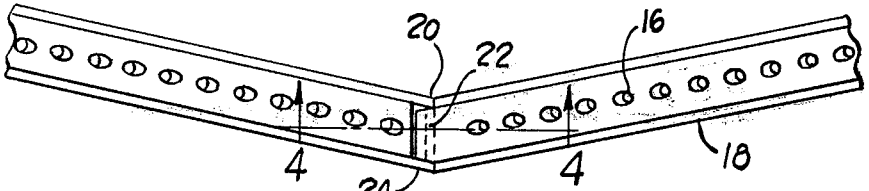
FIG. 3 is a plan view illustrating another portion of the assembly of FIG. 1.

Interlocking structure is provided for longitudinally fastening together adjacent ends of the brush strip substrate portions 18. Referring to FIGS. 3 and 4, the brush strip substrate portions are connected at location 20 by means of locking structure integrally defined by the ends of the brush strip substrate portions themselves.

More specifically, and as shown in FIG. 4, the interlocking structure is embodied by mutually mating end configurations including lip and flanged portions 22, 24. The interlocking structure inhibits outward migration of the brush strip toward the roller body ends which would otherwise tend to result due to rotation of the brush assembly.

Figure 6:
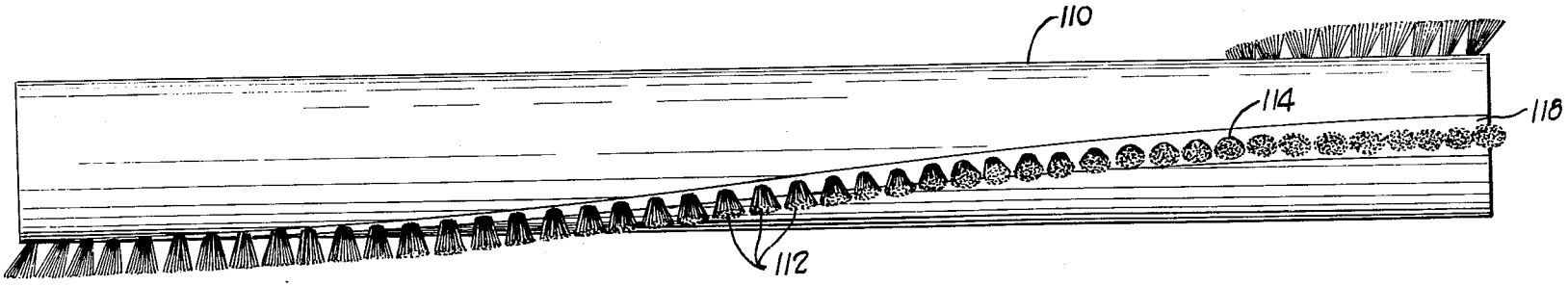
FIG. 6 is an elevational view of another embodiment of a rotary brush assembly of the present invention.
Figure 7:
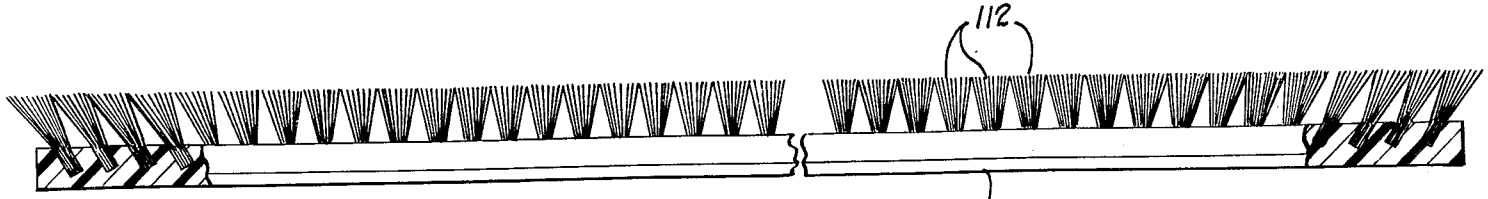
FIG. 7 is an elevational view of a portion of the assembly of FIG. 6.

Another embodiment of a rotary brush assembly is shown in FIGS. 6 and 7. In such an embodiment, the brush strip substrate portion 118 extends the entire length of grooves such as 114 defined in the outer surface of a roller body 110. Obviously, where only a single brush strip portion is utilized in a groove, there is no need for providing the interlocking structure of FIGS. 3 and 4. Moreover, the angulation of the bristle tufts 112 is somewhat different than in the embodiment of FIG. 1.

More specifically, in the FIG. 6 and 7 embodiment, the bristle tufts near a midplane, equally distant between the roller body ends and normal to its axes, are substantially parallel to the midplane and normal to the axis. The outward angulation of bristle tufts with respect to the midplane is an increasing function of the longitudinal distance of the tufts from the midplane. As in the embodiment of FIG. 1, the end tuft has an angulation of approximately thirty degrees outwardly from the midplane.

It is to be understood that the present disclosure is illustrative of the invention, rather than exhaustive. Those of ordinary skill may make additions, deletions or modifications to the disclosed structure without departing from the spirit of the invention, or its scope, as defined in the appended claims:

What is claimed is:

1. A rotary brush assembly comprising:

(a) a generally cylindrical brush roller body having at least one longitudinally extending helical groove defined in its outer surface;

(b) two brush strip substrate portions mounted end to end in each said groove and defining locking structure for coupling together, against relative longitudinal movement, adjacent ends of the substrate portions approximately equidistant the ends of the cylindrical roller body;

(c) a tufted array of bristles mounted on each brush strip substrate portion, said bristles:

(i) having an angle, with respect to a midplane normal to the roller body axis and equidistant its ends, which angle is an increasing function of bristle spacing from said midplane, the angulation of said bristles ranging from approximately parallel to the midplane near the midplane to approximately 30 degrees outwardly from the midplane at the ends of the roller body;

(ii) having a length which is an increasing function of bristle angulation from said midplane, and (iii) having a stiffness which is an increasing function of said bristle angulation.

2. The rotary brush assembly of claim 1, wherein:

(a) said bristles having an angle of less than approximately 15 degrees with respect to said midplane are of a first diameter, and (b) said bristles having an angle of more than approximately 15 degrees to the midplane have a second diameter greater than said first diameter.

3. A rotary brush assembly comprising:

(a) a generally cylindrical roller body;

(b) an array of bristles carried on the roller body, said bristles:

(i) being angled with respect to the roller body axis in an amount which is an increasing function of bristle distance from the midplane of the roller body;

(ii) having a stiffness which is an increasing function of said bristle angle, and (iii) the diameter of said bristle increasing with respect to increasing bristle angle relative to the midplane normal to the roller body axis.

4. A rotary brush assembly comprising:

(a) a generally cylindrical brush roller body defining a midplane located equal distance between the roller body ends;

(b) an array of nylon bristles carried on the roller body, said bristles:

(i) having an angle to said midplane ranging from approximately parallel to said midplane near said midplane to about 30° outwardly from the midplane at the ends of the roller body;

(ii) being angled less than about 15° from the midplane having a diameter of about 0.006 inches, and (iii) being angled more than about 15° to the midplane having a diameter of about 0.008 inches.

* * * * *